US005456326A

United States Patent [19]

Raines

[11] Patent Number: 5,456,326

[45] Date of Patent: Oct. 10, 1995

[54] APPARATUS AND METHOD FOR INSTALLING OPEN-ENDED TUBULAR MEMBERS AXIALLY INTO THE EARTH

[75] Inventor: Richard D. Raines, Houston, Tex.

[73] Assignee: Exxon Production Research Company, Houston, Tex.

[21] Appl. No.: 228,828

[22] Filed: Apr. 18, 1994

[51] Int. Cl.[6] ..... E21B 7/00; E21B 7/20

[52] U.S. Cl. ..... 175/57; 175/171; 175/257

[58] Field of Search ..... 175/7, 9, 57, 215, 175/257, 171, 258

[56] References Cited

U.S. PATENT DOCUMENTS

| | | | |
|---|---|---|---|
| 2,330,083 | 9/1943 | Sewell | 255/74 |
| 3,097,706 | 7/1963 | Kammerer | 175/258 |
| 3,097,707 | 7/1963 | Kammerer | 175/258 |
| 3,196,960 | 7/1965 | Kammerer | 175/267 |
| 3,552,507 | 1/1971 | Brown | 175/258 |
| 3,552,508 | 1/1971 | Brown | 175/258 |
| 3,552,509 | 1/1971 | Brown | 175/258 |
| 3,552,510 | 1/1971 | Brown | 175/261 |
| 3,656,564 | 4/1972 | Brown | 175/228 |
| 3,690,388 | 9/1972 | Hilton et al. | 175/171 |
| 3,747,675 | 7/1973 | Brown | 166/237 |
| 3,870,114 | 3/1975 | Pulk et al. | 175/258 |
| 3,871,486 | 3/1975 | Curington et al. | 175/100 |
| 4,133,396 | 1/1979 | Tschirky | 175/57 |
| 4,202,416 | 5/1980 | Baschke et al. | 175/171 |
| 4,307,705 | 12/1981 | Ortemond | 175/9 X |
| 4,408,669 | 10/1983 | Wiredal | 175/258 |
| 4,702,325 | 10/1987 | Hipp | 173/64 |
| 4,759,413 | 7/1988 | Bailey et al. | 175/171 X |
| 4,966,498 | 10/1990 | Blum | 175/171 X |
| 5,082,069 | 1/1992 | Seiler et al. | 175/171 X |
| 5,197,553 | 3/1993 | Leturno | 175/171 X |

*Primary Examiner*—Ramon S. Britts
*Assistant Examiner*—Frank S. Tsay
*Attorney, Agent, or Firm*—Keith A. Bell

[57] ABSTRACT

An apparatus and a method for installing open-ended tubular members axially into the earth by simultaneously or sequentially driving, drilling, and jetting. A drilling string assembly is located inside the tubular member, but is supported independently from the tubular member. The position of the drill bit on the lower end of the drilling string assembly relative to the lower end of the tubular member may be adjusted so as to control the rate of penetration of the tubular member into the earth.

23 Claims, 4 Drawing Sheets

APPARATUS AND METHOD FOR INSTALLING OPEN-ENDED TUBULAR MEMBERS AXIALLY INTO THE EARTH

FIELD OF THE INVENTION

This invention relates to the installation of open-ended tubular members, such as well conductors or foundation piles, axially into the earth. More particularly, but not by way of limitation, the invention lo pertains to an apparatus and a method which permit the controlled installation of such tubular members by simultaneously or sequentially driving, drilling, and jetting.

BACKGROUND OF THE INVENTION

In the oil and gas industry, open-ended tubular members installed axially into the earth are used for a variety of purposes. For example, open-ended tubular members are frequently used as foundation piles to support the weight of an offshore structure and to resist environmental loads applied to the structure. Open-ended tubular members are also used as well conductors to facilitate the drilling of wells from an offshore platform. Typically, these well conductors extend from the deck of the offshore platform downwardly through the body of water and into the earth to a point which may be located several hundred feet below the bottom of the body of water. Well conductors are required to resist their own weight and, typically, the weight of the first string of well casing (which may be in excess of 300,000 pounds) until it has been cemented to the formation. Other uses of open-ended tubular members installed axially into the earth will be known to those skilled in the art.

Typically, the objective is to install the open-ended tubular member into the earth a distance (known as the target penetration) which is sufficient to mobilize the required load carrying capacity. The load carrying capacity of a tubular member is the sum of the end bearing resistance of the lower end (i.e., the "toe") of the tubular member and the frictional resistance along the outside of the tubular member.

If the tubular member is a well conductor, another objective is to preclude soil fracture during subsequent drilling operations. The ability of the subsurface soils to withstand fracture is known as "fracture integrity." Fracture integrity may be either local or global. Local fracture integrity refers to the ability to withstand fractures along the interface between the conductor and the surrounding soils (also known as "piping"). Global fracture integrity refers to the ability of the soils to withstand fractures at some distance from the wall of the conductor or below the toe of the conductor.

Traditionally, the installation of open-ended tubular members has been accomplished by impact driving in which repeated blows from a large hammer are used to literally pound the open-ended tubular member into the earth. More recently, resonant or vibratory driving techniques have been developed.

Oftentimes, an open-ended tubular member can be installed to the target penetration by impact, resonant, or vibratory driving alone. However, under certain conditions, such as in sandy soils or interbedded sands and clays, high soil resistance that develops along the wall and below the toe of the tubular member may result in a premature driving refusal (i.e., the situation where continued driving efforts do not result in any appreciable advances of the tubular member prior to achieving target penetration). In these situations it may not be possible to install the open-ended tubular member to the target penetration by driving alone.

When an open-ended tubular member is driven into the earth, a soil column will form within the tubular member. As the tubular member moves past the soil column, a frictional resistance develops between the inside wall of the tubular member and the soil column. As this friction increases, the amount of soil entering the tubular member decreases (known as "partial plugging") until the tubular member fully plugs, which occurs when the skin friction along the inside wall of the tubular member becomes equal to or greater than the toe bearing capacity of the cross-sectional area of the tubular member. Thereafter, the tubular member advances, if at all, in the same manner as a closed-ended member.

One consequence of a tubular member penetrating in either a partially or fully plugged condition is that some or most of the soil immediately below the toe of the tubular member, the amount depending on the degree of plugging, is displaced into the surrounding soils. In granular soils, and to a lesser extent in cohesive soils, this displacement produces densification or compaction of the soils immediately adjacent to and below the toe of the tubular member, resulting in increases in both normal and shear intergranular stresses and, accordingly, an increase in the fracture integrity of the surrounding soils. As the tubular member is penetrated into the zone of densified soils, the high intergranular stresses in the soils, which are above the ambient values of the formation, produce high lateral stresses on the outside wall of the tubular member. These high lateral stresses increase the shear capacity, or skin friction, on the outside wall of the tubular member by simple Coulomb friction. Increased toe bearing capacity also results and together with the increased frictional capacity may produce driving refusal prior to achieving the target penetration.

One apparatus that has been proposed for solving the premature refusal problem is disclosed in U.S. Pat. No. 4,702,325 issued Oct. 27, 1987, to James Hipp. The Hipp apparatus consists primarily of an external reciprocal impact driving means supported atop the tubular member and a rotatable drilling means supported within the tubular member for removing the soil plug. In order to protect the drilling means from the adverse effects of the impact driving means, the drilling means is supported within the tubular member at the bottom portion thereof near the point of least energy absorption and rebound. The driving and drilling operations may be performed simultaneously or sequentially.

In the Hipp apparatus, a special landing nipple must be provided on the lower end of the tubular member. This landing nipple includes an internal stop shoulder that cooperates with a lock-in notch located on the lower end of the drill string to support the drilling means. The drill bit is positioned at the toe of the tubular member so that the entire soil plug is removed, and the rates of the driving and drilling operations are adjusted so that the drill bit remains in position at the toe of the tubular member.

Experience has shown that completely removing the soil plug from inside the tubular member, as proposed by Hipp, may permit the tubular member to be installed to the target penetration. When using this technique, however, the target penetration is often achieved at the expense of failing to mobilize the desired load carrying capacity of the tubular member and/or compromising the fracture integrity of the surrounding soils. Failure to mobilize the desired load carrying capacity of a tubular member means that the installed tubular may not be fit for its intended purpose since it may not be able to resist the applied loads. Further, if the tubular member is a well conductor, compromising the fracture integrity of the surrounding soils can lead to lost returns and, potentially, to loss of the well during subsequent drilling operations.

Thus, a need exists for an apparatus and a method which permit open-ended tubular members to be installed to the target penetration in all types of soils without compromising the load carrying capacity of the tubular member or the fracture integrity of the surrounding soils. The present invention satisfies this need.

SUMMARY OF THE INVENTION

It is therefore an object of the present invention to provide an apparatus and a method which permit the controlled installation of open-ended tubular members axially into the earth by simultaneously or sequentially driving, drilling, and jetting.

It is another object of the invention to provide an apparatus and a method which permit an open-ended tubular member to be installed to the target penetration in sandy soils and interbedded sands and clays.

It is still another object of the invention to achieve target penetration in sandy soils and interbedded sands and clays while mobilizing the desired load carrying capacity of the tubular member and maintaining or enhancing the fracture integrity of the formation soils surrounding the tubular member.

It is a primary advantage of the present invention, when compared to conventional technology, that no special equipment or prior planning are required, and accordingly, that the present invention may be utilized in the event unexpected difficulties arise during installation of an open-ended tubular member.

It is another advantage of the invention that any available type of driving means, such as an impact hammer or a resonant or vibratory driver, may be used to drive the tubular member into the earth.

It is still another advantage of the invention that the soil below the toe of the tubular member may be removed to prevent premature refusal of the tubular member.

It is a primary feature of the invention that the height of the soil column within the tubular member may be adjusted so as to control the rate at which the tubular member advances into the earth.

It is another feature of the present invention that the wall thickness of the open-ended tubular member, and hence the cost thereof, may be substantially optimized.

It is yet another feature of the invention that the time and energy required to install the open-ended tubular member to the target penetration without adversely affecting the load carrying capacity of the tubular member or the fracture integrity of the surrounding soils are substantially minimized.

These and other objects, advantages, and features of the present invention will be readily apparent to persons skilled in the art based on the teachings set forth herein.

In a first embodiment, the apparatus of the invention comprises: driving means supported on the upper end of the tubular member for applying force to said tubular member to drive the lower end of said tubular member into the earth, whereby a soil plug forms in at least a lower portion of said tubular member; drilling means located within said tubular member for removing at least a portion of said soil plug, said drilling means including a drill string assembly having a lower end, a drill bit connected to said lower end of said drill string assembly, and means for imparting rotary motion to said drill string assembly; and support means for supporting said drilling means independently of said tubular member, said support means adapted to control and adjust the location of said drill bit relative to said lower end of said tubular member; said driving means and said drilling means operative either simultaneously or sequentially.

In one embodiment, the method of the present invention comprises the steps of applying force to the upper end of the open-ended tubular member to drive said tubular member into the earth, whereby a soil plug forms in at least a lower portion of said tubular member, and controlling the rate at which said open-ended tubular member penetrates into the earth by simultaneously or sequentially removing at least a portion, but not all, of said soil plug.

BRIEF DESCRIPTION OF THE DRAWINGS

The present invention will be better understood by referring to the following detailed description and the attached drawings in which.

While the invention will be described in connection with its preferred embodiments, it will be understood that the invention is not limited thereto. On the contrary, it is intended to cover all alternatives, modifications, and equivalents which may be included within the spirit and scope of the invention, as defined by the appended claims.

DETAILED DESCRIPTION OF THE PREFERRED EMBODIMENTS

The present invention is an apparatus and a method for installing open-ended tubular members axially into the earth. In the following detailed description, it will be assumed that the open-ended tubular member is a well conductor on an offshore platform. However, persons skilled in the art will understand that the present invention may be used in a variety of other applications, such as installation of the foundation piles on-land or for an offshore structure, or installation of surface casing in both on-land and offshore wells. To the extent that the following description is specific to a particular embodiment or a particular use of the invention, this is intended to be illustrative only, and is not to be construed as limiting the scope of the invention.

Figure 1:
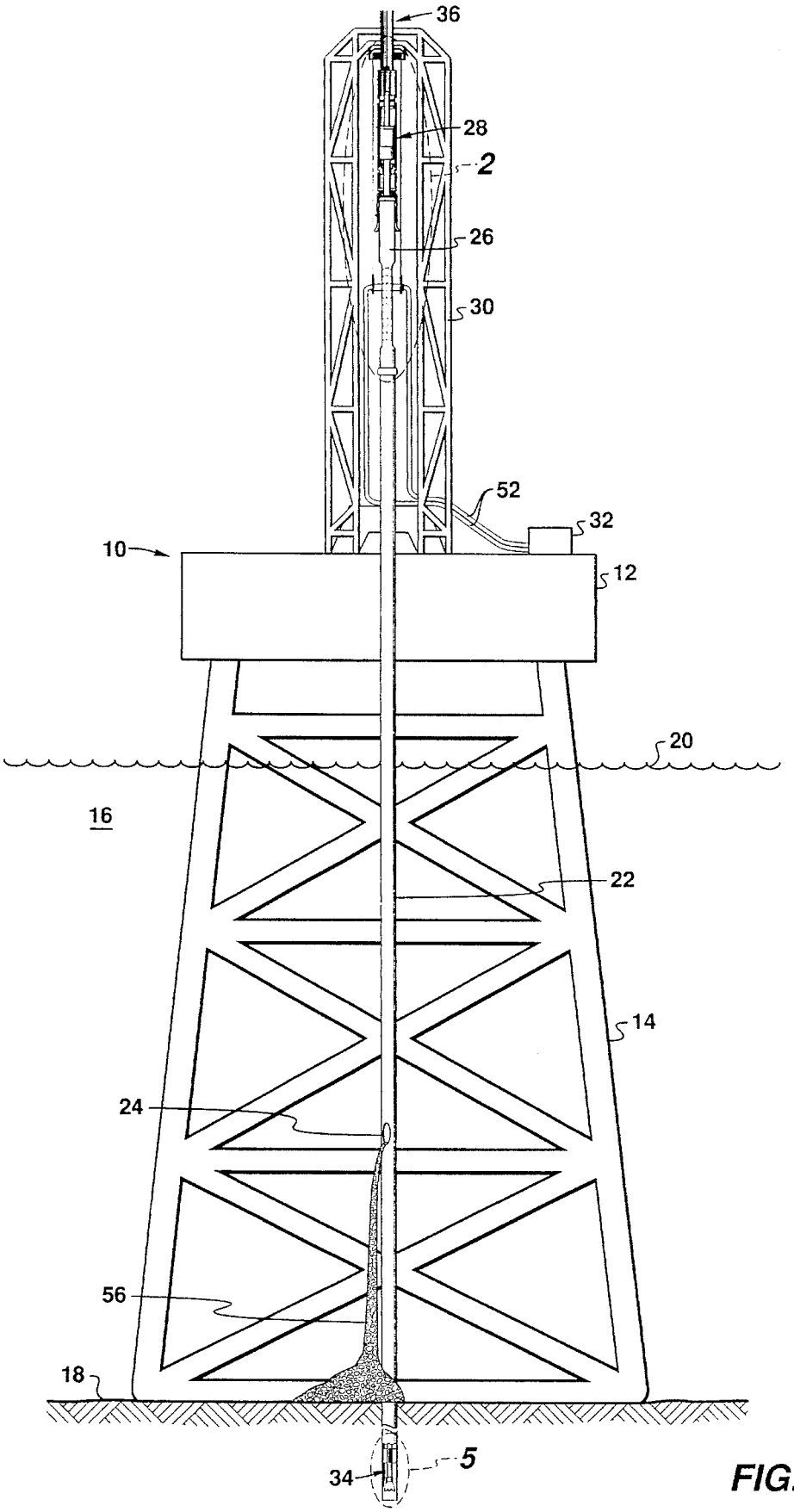
FIG. 1 schematically illustrates the apparatus of the present invention being applied to install a well conductor on an offshore platform.

FIG. 1 schematically illustrates an offshore platform 10 consisting of an above-water deck 12 supported by a steel jacket structure 14. Offshore platform 10 is located in body of water 16. Steel jacket structure 14 rests on the bottom 18 of body of water 16 and extends upwardly to a point located above the surface 20 of body of water 16. Persons skilled in the art will understand that offshore platform 10 may be any other type of bottom-founded offshore structure, such as a concrete gravity structure.

A well conductor 22 is illustrated extending from above deck 12 to a point located below the bottom 18 of body of water 16. All subsequent drilling operations for the well in question are performed through well conductor 22. Well conductors may be as much as 36 inches or more in diameter, and a typical offshore platform has a plurality (up to 48 or even more) of wells. For purposes of clarity, only one well conductor is shown in FIG. 1.

Typically, well conductors are driven into the earth to a depth where the surrounding soils are cohesive enough so that they will not slough into the open hole during subsequent drilling operations. The soils below the well conductor should also be strong enough so that they will not fracture during subsequent drilling operations. As is well known to persons skilled in the art, the hydrostatic pressure exerted by a column of drilling fluid extending upwardly to the deck of an offshore platform can be high enough to fracture shallow formations. This problem can be especially severe in deep waters (e.g., 500 feet or more) because the large hydrostatic pressure that will be exerted on the formation during subsequent drilling operations may dictate a target penetration of several hundred feet. As noted above, it may not be possible to achieve such large target penetrations by driving alone, especially where the subsurface soils into which the well conductor is to be driven consist of sands or interbedded sands and clays. If the target penetration is not achieved, then an extra string of casing is typically required in order to complete the well.

The present invention permits the controlled installation of open-ended tubular members by simultaneously or sequentially driving, drilling, and jetting. Use of the present invention improves the chances of achieving target penetration, especially in sandy soils, while facilitating mobilization of the desired load carrying capacity of the tubular member. Moreover, the fracture integrity of the surrounding formations soils is maintained or, in some cases, enhanced through use of the invention. The invention substantially minimizes the time and energy necessary to install an open-ended tubular member and permits the wall thickness (and hence, the cost) of the tubular member to be optimized.

Referring again to FIG. 1, the installation string for the present invention consists of conductor 22 which contains an opening 24 for disposing of soil cuttings, the simultaneous drive-drill (hereinafter, "SDD") apparatus of the present invention 26 which is supported on top of conductor 22, and a driving means 28 which is supported on top of SDD apparatus 26. Also shown in FIG. 1 are a guide frame 30 which is one way to independently support the SDD apparatus and attached drill string, as more fully described below, a drilling fluid pump 32 for circulating drilling fluid to the bottom-hole assembly 34, and a guide rail 36 which provides lateral support for the driving means 28 and permits it to move downward simultaneously with SDD apparatus 26 and conductor 22.

The primary difference between the present invention and the Hipp apparatus, described above, is that the present invention permits the drill string to be supported independently of conductor 22 and driving means 28. Therefore, the loads applied to conductor 22 by driving means 28 do not pass through the drill string. Further, as described below, in the present invention the drill bit may be positioned at locations either above or below the toe of the conductor, while the drill bit in the Hipp apparatus is intended to remain in position at the toe of the conductor.

In FIG. 1, the installation string is shown in a substantially vertical position. However, persons skilled in the art will understand that open-ended tubular members are often installed into the earth at an inclined angle somewhere between vertical and horizontal (e.g., battered foundation piles on an offshore platform and conductors for deviated wells). The present invention may be used in all such applications.

Figure 2:
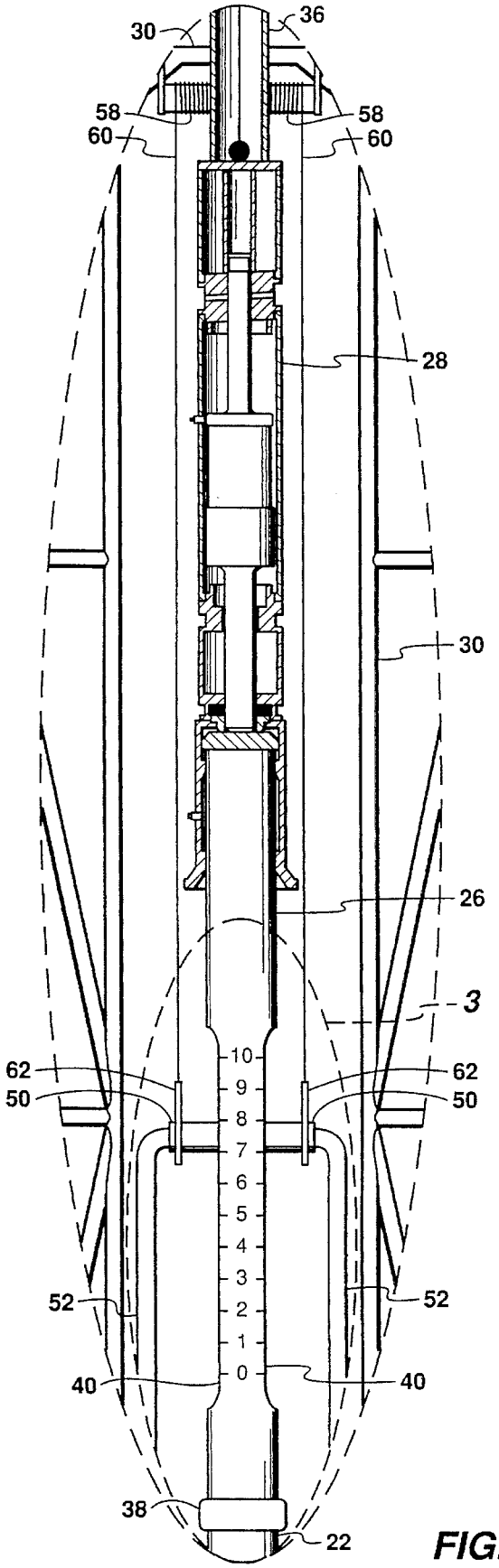
FIG. 2 is an enlarged view of a portion of FIG. 1 showing the upper end of the installation string assembly in greater detail.
Figure 3:
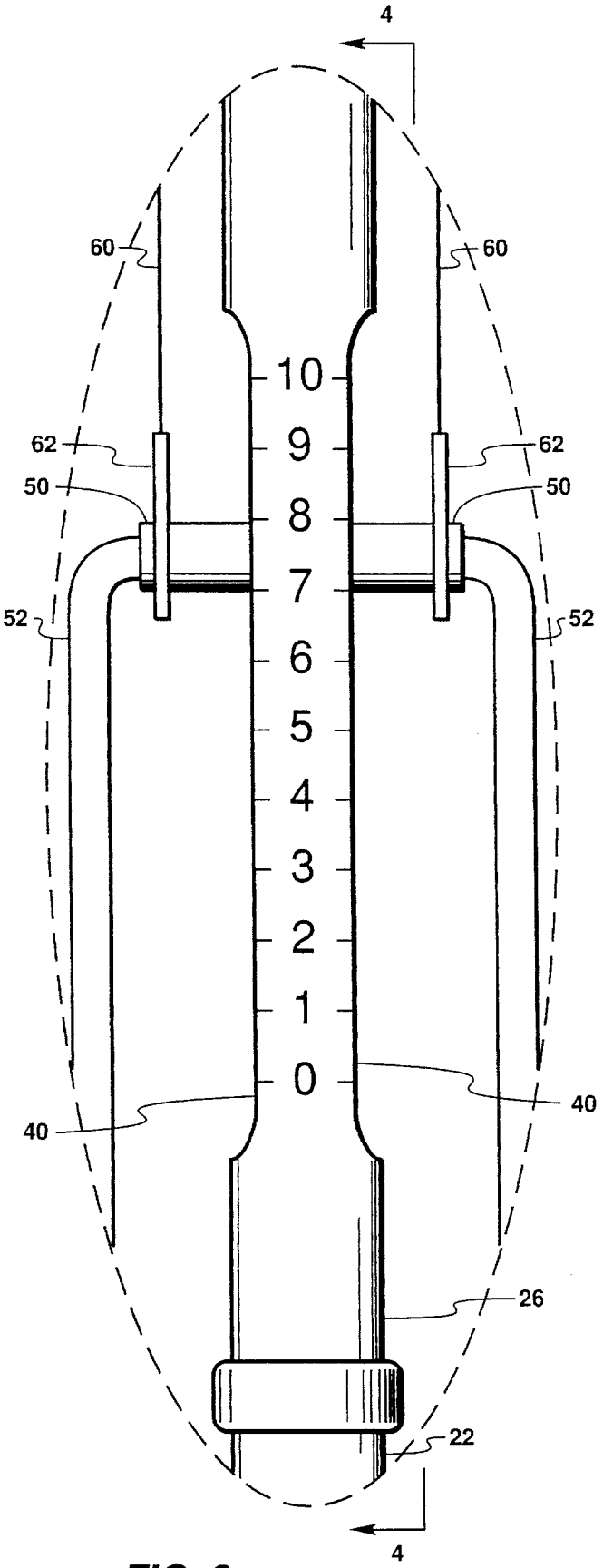
FIG. 3 is a further enlarged view of a portion of FIG. 2 showing part of the simultaneous drive-drill apparatus of the present invention.
Figure 4:
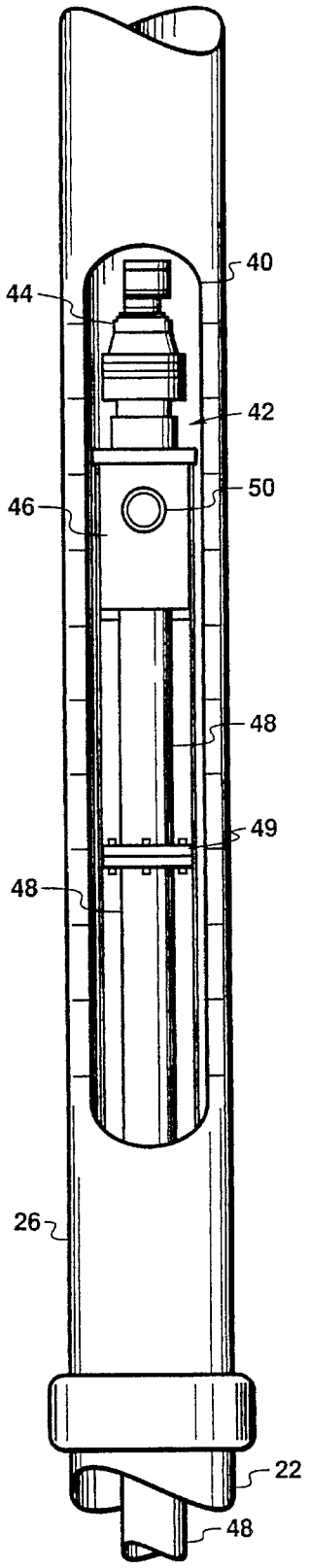
FIG. 4 is a side view of a portion of the apparatus of the present invention taken along line 4–4 of FIG. 3.

FIGS. 2, 3, and 4 show more detail of the SDD apparatus 26. Referring first to FIG. 2, SDD apparatus 26 is connected to the upper end of conductor 22 by connector 38 which may be any suitable type of tubular connection used in oil field operations. Driving means 28 is supported on the upper end of SDD apparatus 26 and is guided by guide rail 36. Driving means 28 may be any type of device which is capable of applying a downward force to conductor 22, such as an impact hammer or a resonant or vibratory driver. Accordingly, driving means 28 will not be further described herein.

SDD apparatus 26 comprises a tubular member having a lower end adapted for connection to the upper end of conductor 22, an upper end adapted for supporting driving means 28, and means for independently supporting a drill string assembly located inside conductor 22 and SDD apparatus 26. Two diametrically opposed, elongated longitudinal slots 40 are formed in the wall of SDD apparatus 26. The vertical graduations between slots 40 are used to aid in correlating the position of the drill bit to the toe of conductor 22. For purposes of illustration, the "0" mark may correspond to having the drill bit located at the toe of the conductor and the "10" mark may correspond to the drill bit located 10 feet above the toe of the conductor. Alternatively, as described below, the length of the drill pipe may be adjusted so that the "0" mark corresponds to the lowest possible location of the drill bit and the "10" mark corresponds to the highest location (e.g., "0" could correspond to a position 2 feet below the toe of the conductor, in which case "10" would correspond to a position 8 feet above the toe).

As best illustrated in FIG. 4, a drilling string assembly 42 is located inside SDD apparatus 26 and conductor 22. Drilling string assembly 42 includes a drill motor 44, a drilling fluid chamber 46, a drill pipe 48 which extends downwardly to the bottom-hole assembly 34 (see FIG. 1), two diametrically-opposed support arms 50 (see FIG. 3) which project radially outwardly through slots 40, and two drilling fluid supply lines 52 which provide drilling fluid to drill string assembly 42. Preferably, support arms 50 also serve as drilling fluid inlet nozzles, and drilling fluid supply lines 52 attach to the outer ends of support arms 50. Alternatively, separate means for attaching drilling fluid supply lines 52 to drilling fluid chamber 46 may be provided. A flanged connector 49 is used to connect the section of drill pipe 48 located in SDD apparatus 26 to the rest of drill pipe 48. This allows SDD apparatus 26 to be disconnected from casing 22 and drill pipe 48 without rotating the entire apparatus.

Figure 5:
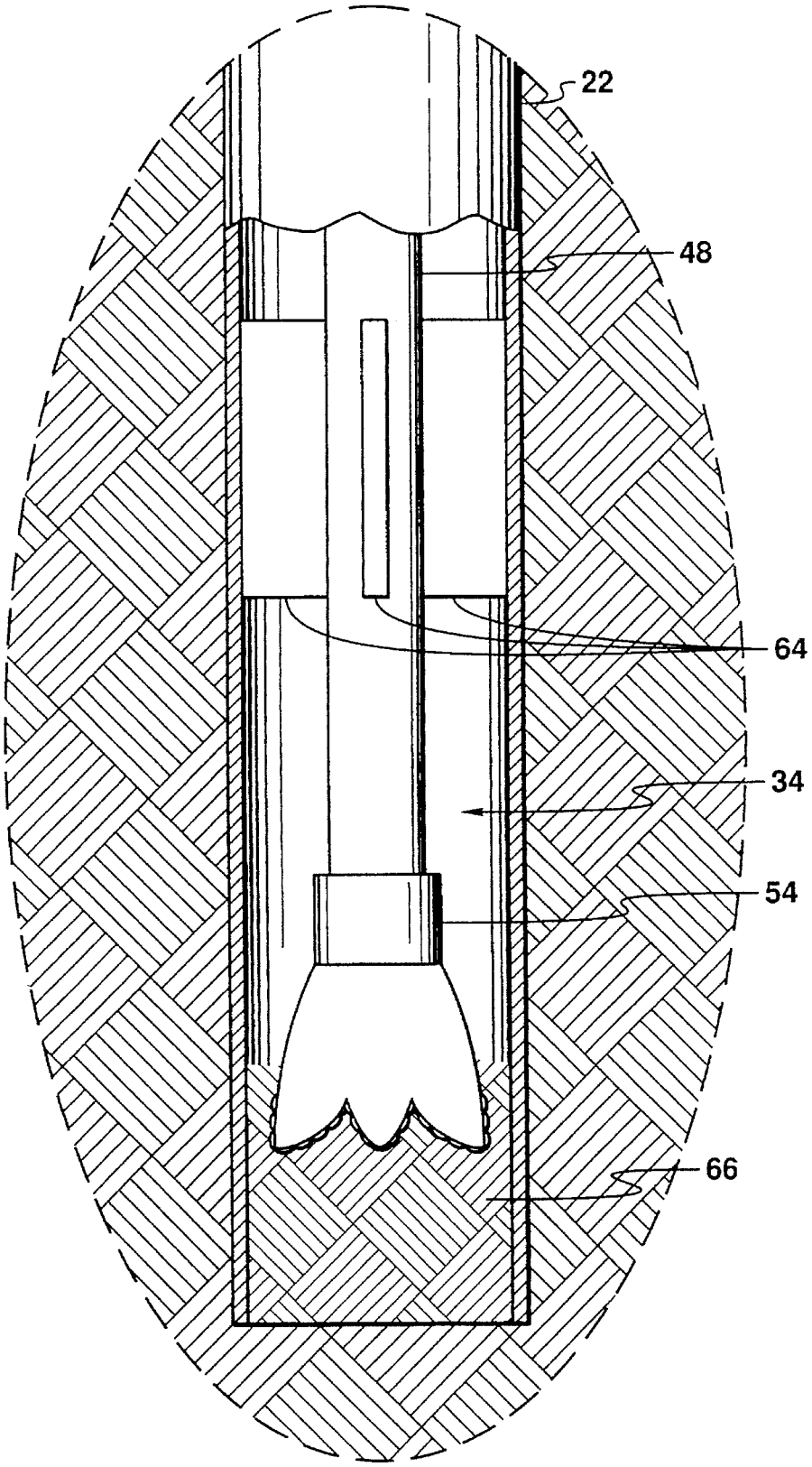
FIG. 5 is an enlarged view of a portion of FIG. 1 showing the bottom-hole assembly.

Drilling fluid enters drilling fluid chamber 46, flows downwardly in drill pipe 48, and exits the drill string assembly through jets located in drill bit 54 (see FIG. 5). The drill fluid then flows upwardly in the annulus between the outside of drill pipe 48 and the inside of conductor 22 carrying soil cuttings with it. An opening 24 (see FIG. 1)is provided in the underwater portion of conductor 22, and the soil cuttings 56 are allowed to exit conductor 22 and fall to the sea floor 18 through this opening. Persons skilled in the art will understand that drilling fluid and/or sea water will rise in the annulus between drill pipe 48 and conductor 22 to approximately the level of the surface 20 of body of water 16, but that no drilling fluid returns will reach SDD apparatus 26. The opening 24 may be positioned at any point along conductor 22, as long as it is not below the sea floor 18 at target penetration. Thus, the opening 24 should preferably be located above the toe of conductor 22 a distance slightly greater than the target penetration.

Alternatively, as will be well known to persons skilled in the art, conductor 22 and drilling string assembly 42 could be configured such that all returns of drilling fluid and soil cuttings occur on platform 12. In this case, additional equipment for handling these returns would be required. See, e.g., column 3, line 42 to column 4, line 14 and related drawings of the above-described U.S. Pat. No. 4,702,325 to Hipp.

As noted above, drilling string assembly 42 must be supported independently of conductor 22 so that driving loads imposed on conductor 22 by driving means 28 do not adversely affect drilling string assembly 42. One way to accomplish this is illustrated in FIG. 2. An electric winch 58 is mounted on guide frame 30 generally above SDD apparatus 26. Support cables 60 are attached at one end to support arms 50 by suitable connectors 62 and at the other end to winch 58 to support the weight of drilling string assembly 42. Winch 58 may be used to adjust the length of support cables 60 and thereby to change the position of drill bit 54 relative to the toe of conductor 22. As noted above, the vertical graduations on the outside of SDD apparatus 26 are used to indicate the position of drill bit 54.

FIG. 5 illustrates the bottom-hole assembly 34. A drill bit 54 containing a plurality of drilling fluid jets (not shown) is attached to the lower end of drill pipe 48. Centralizers 64 are used to maintain drill pipe 48 in the center of conductor 22. Additional centralizers (not shown) may be spaced along the entire length of drill pipe 48. Other conventional downhole equipment, such as drill collars to provide weight on the drill bit, may be used as desired. A soil plug 66 is shown in the lower end of conductor 22. The location of drill bit 54 relative to the lower end of conductor 22 may be adjusted, as described above, so as to control the height of soil plug 66. For example, in FIG. 3, the length of cables 60 has been adjusted so that the drill bit is positioned approximately 7½ feet above the toe of conductor 22 (assuming that the "0" mark corresponds to having the drill bit located at the toe of the conductor).

In practicing the method of the present invention, the first step is to raise the conductor into position and allow it to penetrate into the ground under its own weight. Next, the drill pipe, with drill bit and centralizers attached, is lowered into the conductor to a position just above the top of the soil column and is secured to the top of the conductor using conventional drilling methods. The SDD apparatus is then positioned over the conductor and the drill pipe in the conductor is attached to a section of drill pipe (and the other drill string equipment, described above) in the SDD apparatus. Next the support cables are attached to the support arms and tensioned thereby providing independent support for the entire drill string assembly. The drill string support at the top of the conductor is then removed. Next, the SDD apparatus is lowered onto and connected to the conductor, and the driving means is lowered onto the SDD apparatus and connected. The installation begins by activating the drilling string assembly and circulating drilling fluid down the drill pipe and out the jets in the drill bit. This continues until sufficient soil is removed to lower the drill bit to a predetermined location inside the conductor. The driving means is then activated and the input energy and drill bit location are adjusted, as necessary, to maintain the prescribed rate of advance. These adjustments can be made simultaneously or sequentially and without interruption to installation operations.

Once a section of conductor has been installed, the driving means is removed from the top of the SDD apparatus and the SDD apparatus is disconnected from and lifted off the top of the conductor. The drill pipe in the conductor is disconnected from the section of drill pipe in the SDD apparatus and is secured to the top of the conductor using conventional drilling methods. The next section of conductor for installation is fitted with an equal length of drill pipe suspended internally from the top of the conductor section and positioned above the previous conductor section. The two sections of drill pipe are connected after which the two sections of conductor are connected. The SDD apparatus and driving means are then reconnected and the installation proceeds as described above. When the target penetration is reached, the driving means, SDD apparatus, and drill string assembly are removed for possible use in installing another conductor.

To make the most effective use of the SDD apparatus, a comprehensive installation methodology should be developed to guide and, if necessary, refine the installation procedure. This methodology should include selecting the driving means and sizing the conductor with dynamic analysis for the anticipated soil resistance; developing a target relationship between driving energy and conductor penetration for the entire penetration of the conductor; measuring and controlling in real time the energy imparted to the conductor by the driving means; recording energy imparted versus penetration in real time; and making adjustments in real time to input energy, drill bit location, jet pump pressure, and/or drill bit rotation speed to maintain the desired rate of penetration.

As noted above, one advantage of the present invention, when compared to the Hipp apparatus, is that no special equipment or prior planning are required for use of the invention. Therefore, if unexpected difficulties are encountered during installation of a tubular member, the SDD apparatus may be inserted and installation operations may proceed. The Hipp apparatus cannot be used in this manner since the special landing nipple must be installed on the lower end of the tubular member before installation operations commence.

The benefits of the present invention result from the fact that the length of the soil column inside the tubular member influences the amount of soil resistance during installation, and ultimately the load carrying capacity of the tubular member and the fracture integrity of the formation. To control the soil resistance in a simultaneous driving and drilling operation, it is necessary to have the capability to reposition the drill bit/jet head over an interval of several feet relative to the toe of the tubular member, without interrupting drilling operations. This allows the operator to control the formation of the soil plug within the tubular member which in turn exerts a strong influence on the compaction of the soil below the toe of the tubular member and ultimately on the end bearing resistance of the tubular member and the frictional resistance along the outside of the tubular member.

Persons skilled in the art will recognize that the present invention can be easily adapted to remove the formation soils below the tubular member, if desired. For example, by adding an additional ten foot section of drill pipe to the drill string assembly, the drill bit could be positioned at any point between the toe of the tubular member and ten feet below the tubular member. Use of the invention in this manner may be beneficial, for example, to prevent a tubular member from refusing prematurely or to restart a tubular member which has refused. As another example, the drill pipe length could be selected so that the ten foot adjustment range provided by the SDD apparatus permits the drill bit to be positioned at any point from eight feet above the toe of the tubular member to two feet below the toe. In this manner, the SDD apparatus may be used, as described above, to control the length of the soil plug or, if potential problems arise, to remove the soil from below the toe of the tubular member.

As noted above, use of the SDD apparatus permits the wall thickness of the tubular member to be optimized. High soil resistances which develop below a fully plugged tubular member necessitate a thick wall in order to effectively transmit the driving energy to the toe of the tubular member. By removing a portion of the soil plug, the soil resistance can be reduced thereby permitting use of a thinner wall.

EXAMPLES

The SDD apparatus has been proof tested at an onshore location and used successfully to install conductors on an offshore platform. The tubular member for the onshore test had an outside diameter of 26 inches, a wall thickness of 0.75 inches, and a length of 259 feet, and was installed to a penetration below ground of approximately 252 feet. The offshore conductors were fabricated from the same size steel tubing, but had lengths of approximately 1500 feet and were installed to a penetration of approximately 290 feet below the bottom of the body of water (which had a depth in excess of 1000 feet). In both cases, an impact hammer was used. The stratigraphy at both sites consists predominantly of dense sands with occasional thin layers of interbedded clays.

During proof testing and use offshore, measurements were made to determine the effectiveness of the SDD apparatus and SDD installation methodology. The results of these measurement programs support the following conclusions:

1. The soil resistance along the wall of the tubular member is dependent on the location of the soil plug inside the tubular member.
2. The SDD installation methodology permits customizing the soil resistance and, thus, the load carrying capacity of the tubular member.
3. The SDD installation methodology preserves the fracture integrity of the formation.
4. Positioning the drill bit at the toe of the tubular member (as in the Hipp apparatus) can, under some circumstances, lead to uncontrolled penetration of the tubular member.
5. Contrary to the teachings of Hipp, tubular members driven to refusal cannot always be restarted by removing the entire soil plug.

During the on-land proof testing and installation of the first conductor offshore, dynamic monitoring of the hammer and the tubular member was conducted using strain transducers and accelerometers. The data from this instrumentation was used to determine the energy imparted by the hammer and to calculate the soil resistance along the wall of the tubular member and below the is toe of the tubular member using CAPWAP, a commercially available computer program developed and marketed by Goble, Rausche, Likins and Associates, Inc. of Warrensville Heights, Ohio. The results of these analyses directly support conclusions 1 and 2 above.

During the on-land proof testing, the length of the soil column inside the tubular member was varied to measure its influence on soil resistance. Hammer blows were analyzed at penetrations of 203 feet and 218 feet, corresponding to soil column lengths inside the tubular member equal to approximately 183 feet and 4 feet, respectively. A third analysis was also performed at a penetration of 230 feet after the soil column was completely removed. The change in soil resistance as a result of varying the length of the soil column was evident from the decrease in the number of hammer blows required to drive the tubular member, from 172 blows per foot at 203 feet penetration, to 53 blows per foot at 218 feet penetration, to 13 blows per foot at 230 feet penetration. CAPWAP analyses performed on the data obtained during dynamic monitoring indicated a reduction in soil resistance from 800 kips to 533 kips to 295 kips at the three penetrations. It follows from these results that (1) the soil resistance along the wall of the tubular member can be controlled by varying the length of the soil column inside the conductor; (2) the load carrying capacity of the tubular member can be customized, within limits, for a particular application; and (3) changes in driving blow counts can be a reliable indicator of changes in soil resistance.

The data resulting from the on-land proof testing formed much of the basis for the installation procedure developed for the offshore conductors. The goals to be achieved in installing the offshore conductors were threefold: (1) install the conductors to approximately 290 feet penetration; (2) develop sufficient resistance along the sides of the conductor to support the weight of 1500 feet of 16 inch diameter drilling casing; and (3) preserve the fracture integrity of the formation soils. The installation procedure for the offshore conductors included all the steps in the operational method described above plus the following:

1. After the conductor was allowed to reach self weight penetration at approximately 27 feet and the drill bit was lowered into the conductor and circulation begun, drilling and jetting continued until all but four feet of the soil column was removed.
2. The hammer was then activated and driving began at a reduced energy of approximately 22 k-feet (50% of maximum imparted energy) so that a target driving blow count in the range of 10 to 25 blows/foot could be maintained.
3. As the conductor penetrated deeper below the mudline and the driving blow counts increased to values near 25 blows/foot, the target range of driving blow counts was maintained by first increasing the energy of the hammer to approximately 30 k-feet and subsequently by reducing the length of the soil column inside the conductor to 1 to 2 feet. These measures were successful in maintaining the target driving blow count to approximately 200 feet penetration.
4. At 200 feet penetration the goal was to gradually increase the driving blow counts until a target value of aproximately 125 blows/foot was achieved at the final conductor penetration of 286 feet. This goal was achieved by first increasing the hammer energy up to maximum values, as increases in driving blow counts warranted, and subsequently by varying the length of the soil column inside the conductor. At final penetration, it was an objective to have a minimum soil column length inside the conductor of at least two to three feet.

As will be described in the following paragraphs, this procedure was successful not only in satisfying the target final driving blow count (122 blows/foot versus the target of 125 blows/foot) but, more importantly, in achieving the three goals of the installation.

After the first conductor was installed offshore, the remaining soil column was drilled out to a penetration some six feet below the toe of the conductor and a pressure test was performed to see if the SDD installation methodology preserved the fracture integrity of the formation. The results showed the formation to be capable of withstanding fluid pressures in excess of those typically measured in similar formations at similar penetrations for conductors installed by conventional drilling or conventional driving and drilling operations. This increase in fracture integrity can likely be attributed to a localized increase in density of the soil surrounding the conductor. This increase in density was achieved by permitting the controlled formation of the soil column in the conductor during installation.

The final goal of the installation, to develop sufficient soil resistance along the wall of the conductor to support the first string of drill casing, was realized shortly after the final conductor was installed. The first string of well casing was drilled into place approximately 1200 feet beyond the penetration of the conductor and then attached to the top of the conductor for support. The conductor supported the well casing without perceptible displacement. During the installation of one of the offshore conductors, at approximately 131 feet penetration, data were obtained on the effect of positioning the drill bit close to the toe of the conductor when penetrating a clay layer. The drill bit was positioned approximately 2 feet above the conductor toe so that some end bearing resistance would be available to minimize the risk of the conductor "free-falling" as the toe entered the clay layer. Nevertheless, upon entering the clay layer the conductor advanced approximately 5 feet after being struck by only one hammer below. As a result, it was necessary to reposition the drill bit approximately 7 feet above the toe of the conductor to prevent further uncontrolled displacements. Had the drill bit been positioned at the toe of the conductor, as in the Hipp apparatus, the conductor would likely have plunged much farther. A "free-falling" conductor is a significant safety hazard to construction personnel.

Prior to initiating the SDD installation methodology, an attempt was made to continue installation of a conductor previously driven to refusal at approximately 190 feet penetration or approximately 100 feet short of target penetration. The soil column was drilled/jetted-out to the toe of the conductor and attempts were made to advance the conductor by driving. Approximately 800 hammer blows were delivered to the conductor but the conductor advanced less than one inch. The conductor was then drilled/jetted-out to approximately six feet beyond the toe of the conductor and struck approximately 1300 hammer blows but, again, advanced no meaningful distance. This demonstrates that it may not be possible to restart a conductor which has been driven to refusal, even after removing the entire soil column.

It should be understood that the invention is not to be unduly limited to the foregoing which has been set forth for illustrative purposes. Various modifications and alternatives will be apparent to persons skilled in the art without departing from the true scope of the invention, as defined in the following claims:

I claim:

1. Apparatus for installing an open-ended tubular member axially into the earth, said tubular member having an upper end and a lower end, said apparatus comprising:

driving means supported on said upper end of said tubular member for applying force to said tubular member to drive said lower end of said tubular member into the earth, whereby a soil plug forms in at least a lower portion of said tubular member;

drilling means located within said tubular member for removing at least a portion of said soil plug, said drilling means including (i) a drill string assembly having a lower end, (ii) a drill bit connected to said lower end of said drill string assembly, and (iii) means for imparting rotary motion to said drill string assembly; and Support means for supporting said drilling means independently of said tubular member, said support means adapted to control and adjust the location of said drill bit relative to said lower end of said tubular member;

said driving means and said drilling means adapted to be operated concurrently to control the rate at which said tubular member penetrates into the earth.

2. The apparatus of claim 1, wherein said driving means is an impact hammer.

3. The apparatus of claim 1, wherein said driving means is a resonant driver.

4. The apparatus of claim 1, wherein said driving means is a vibratory driver.

5. The apparatus of clam 1, wherein said tubular member is oriented in a substantially vertical position.

6. The apparatus of claim 1, wherein said tubular member is oriented in an inclined position.

7. The apparatus of claim 1, wherein said support means comprises a guide frame, an electric winch attached to said guide frame, and one or more cables attached to said winch and to said drilling means.

8. The apparatus of claim 1, wherein said tubular member is located on an offshore structure, and wherein an opening is formed in the subsea portion of said tubular member for subsea disposal of soil cuttings from said drill bit.

9. The apparatus of claim 1, wherein the length of said drill string is adjusted so as to position said drill bit below said lower end of said tubular member, whereby the soils below said lower end of said tubular member are removed.

10. A method for installing an open-ended tubular member axially into the earth, said open-ended tubular member having an upper end and a lower end, said method comprising the steps of:

applying force to said upper end of said tubular member to drive said lower end of said tubular member into the earth, whereby a soil plug forms in at least a lower portion of said tubular member; and controlling the rate at which said open-ended tubular member penetrates into the earth by concurrently removing at least a portion, but not all, of said soil plug while said tubular member is being driven into the earth.

11. A method for installing an open-ended tubular member axially into the earth, said open-ended tubular member having an upper end and a lower end, said method comprising the steps of:

supporting a driving means on said upper end of said tubular member;

using said driving means to apply force to said tubular member to drive said tubular member into the earth, whereby a soil plug forms in at least a lower portion of said tubular member;

locating a drilling means inside said tubular member for removing at least a portion of said soil plug, said drilling means adapted to be supported independently of said tubular member and having a drill bit attached to the lower end thereof;

providing support means for supporting said drilling means independently of said tubular member, said support means adapted to control and adjust the location of said drill bit with respect to said lower end of said tubular member; and operating said driving means and said drilling means either simultaneously or sequentially to control the rate at which such tubular member penetrates into the earth.

12. The method of claim 11, wherein said step of operating said driving means and said drilling means simultaneously or sequentially includes adjusting said location of said drill bit with respect to said lower end of said tubular member so as to control the amount of soil resistance encountered by said tubular member.

13. The method of claim 11, wherein said driving means is an impact hammer.

14. The method of claim 13, further comprising the step of monitoring the rate at which said tubular member penetrates into the earth by counting the number of blows of said impact hammer required for a given unit of penetration.

15. The method of claim 14, wherein said driving means and said drilling means are adjusted to maintain a preselected blow count per unit of penetration.

16. The method of claim 11, wherein said driving means is a resonant driver.

17. The method of claim 11, wherein said driving means is a vibratory driver.

18. The method of claim 11, wherein said tubular member is oriented in a substantially vertical position.

19. The method of claim 11, wherein said tubular member is oriented in an inclined position.

20. The method of claim 11, wherein said drill bit is positioned below said lower end of said tubular member, whereby the soils below said lower end of said tubular member are removed.

21. The method of claim 1.1, wherein said tubular member is located on an offshore structure, and wherein the subsea portion of said tubular member includes an opening for subsea disposal of soil cuttings from said drill bit.

22. A method for installing an open-ended tubular member axially into the earth, said tubular member having a lower end and an upper end, said method comprising the steps of:

supporting a driving means on said upper end of said tubular member for applying energy to said upper end of said tubular member to drive said lower end of said tubular member into the earth;

providing said tubular member with an internal, independently supported, rotatable drilling means having a drill bit located on the lower end thereof, said drill bit including jet means for directing pressurized drilling fluid at the soil below said drill bit, said drilling means adapted to be axially movable with respect to said tubular member so as to control and adjust the location of said drill bit relative to said lower end of said tubular member;

determining a target rate of penetration of said tubular member into the earth;

measuring the actual rate of penetration of said tubular member into the earth; and making adjustments to one or more of said energy applied to said tubular member, said location of said drill bit relative to said lower end of said tubular member, the rotation speed of said drill bit, and the pressure of said drilling fluid to maintain said actual rate of penetration of said tubular member into the earth at or near said target rate of penetration.

23. A method for installing an open-ended tubular member axially into the earth, said open-ended tubular member having an upper end and a lower end, said method comprising the steps of:

applying force to said upper end of said tubular member to drive said lower end of said tubular member into the earth, whereby a soil plug forms in at least a lower portion of said tubular member; and concurrently removing at least a portion, but not all, of said soil plug while said tubular member is being driven into the earth so as to achieve the desired penetration while controlling the state of stress in the soils surrounding the tubular member.

* * * * *